US006171649B1

(12) United States Patent
Keener et al.

(10) Patent No.: US 6,171,649 B1
(45) **Date of Patent: *Jan. 9, 2001**

(54) METHOD FOR PREPARING PRE-COATED ALUMINUM-ALLOY COMPONENTS AND COMPONENTS PREPARED THEREBY

(75) Inventors: Steven G. Keener, Trabuco Canyon; Norman R. Byrd, Villa Park, both of CA (US)

(73) Assignee: The Boeing Company, Seattle, WA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 09/198,382

(22) Filed: Nov. 24, 1998

(51) Int. Cl.[7] ..... B05D 7/00
(52) U.S. Cl. ..... 427/213; 427/424; 427/214
(58) Field of Search ..... 427/213, 328, 427/424, 214

(56) References Cited

U.S. PATENT DOCUMENTS

Re. 32,307 * 12/1986 Glatt et al. ..... 366/102
4,323,312 * 4/1982 Glatt et al. ..... 366/102
4,656,056 * 4/1987 Leuenberger ..... 427/213
5,328,720 * 7/1994 Emken et al. ..... 427/213
5,614,037 * 3/1997 Keener ..... 148/537
5,858,133 * 1/1999 Keener ..... 148/537
5,922,472 * 7/1999 Keener ..... 428/472.2
5,944,918 * 8/1999 Keener ..... 148/251

OTHER PUBLICATIONS

Encyclopedia of Chemical Technology, vol. 18, 4th Ed., Kirk and Othmer, eds., pp. 603–627, esp. p. 606, May 9, 1996.*

* cited by examiner

*Primary Examiner*—Timothy Meeks
*Assistant Examiner*—Paul D. Strain
(74) *Attorney, Agent, or Firm*—Alston & Bird LLP

(57) ABSTRACT

An improved, pre-coated aluminum-alloy aircraft component prepared by providing an aluminum-alloy component precursor to a coating apparatus having a fluidized-bed or mist apparatus, suspending the components in the fluidized-bed apparatus vertically at a distance from the bottom of the apparatus and introducing a coating to the apparatus to coat the components while being suspended in the airstream flowing through the apparatus. The non-contact, fluidized-bed or mist coating method allows for the coating of increased batch sizes in shorter coating times with decreased variations in coating thickness and uniformity.

25 Claims, 4 Drawing Sheets

METHOD FOR PREPARING PRE-COATED ALUMINUM-ALLOY COMPONENTS AND COMPONENTS PREPARED THEREBY

BACKGROUND OF THE INVENTION

This invention relates to preparing pre-coated, aluminum alloy-based components. In particular, the present invention relates to the use of fluidized-bed coating processes to coat aluminum-alloy aircraft structural components.

It has recently been discovered that the corrosion protection and ease of installation and processing of certain aluminum-alloy aircraft components can be improved by pretreating the alloys with an organic coating prior to installation. Such pretreatment reduces processing time and commensurate cost, while obviating conventional use of toxic solvents that pose difficult and expensive disposal problems.

Such advances are the subject of commonly owned U.S. Pat. No. 5,614,037 the entire contents of which are incorporated by reference herein. As disclosed therein, it has been the practice to coat some types of fasteners with organic coatings to protect the base metal of the fasteners against corrosion damage. In the usual approach, the fastener is first fabricated and then heat-treated to its required strength. After heat-treatment, the fastener is etched with a caustic soda bath or otherwise cleaned to remove the scale produced in the heat-treatment. Optionally, the fastener is alodined or preferably anodized. The coating material, dissolved in a volatile carrier liquid, is applied to the fastener by spraying, dipping, or the like. The carrier liquid is then evaporated. The pre-coated fastener is heated to an elevated temperature for a period of time to heat treat the alloy, and simultaneously cure the coating. The finished fastener is then used in the fabrication of the aircraft structure.

As explained in U.S. Pat. No. 5,614,037, it has not been the practice to coat high-strength, aluminum-alloy fasteners and other structural components with curable coatings, because it is observed that the normally accepted curing treatment for the coating can adversely affect the strength of the components. The uncoated aluminum-alloy components are therefore more susceptible to corrosion than would otherwise be the case.

The absence of the coating means that aluminum components such as rivets, fasteners, etc., must be installed using a wet-sealant compound for purposes of corrosion protection and ease of installation. The wet-sealant compound typically contains toxic components and therefore requires precautions for the protection of the personnel using it and for environmental protection. It is also messy and difficult to work with, and requires extensive cleanup of the area around the fastener using caustic chemical solutions.

The procedural advances described in U.S. Pat. No. 5,614,037 address many of these needs. However, for certain aircraft components, including fasteners, coating uniformity is essential. While coatings can be applied in many ways, many known application techniques including rack and barrel systems, conveyer systems or plasma vapor deposition do not provide the required tolerances and uniformity for irregularly-shaped aluminum alloy aircraft components such as rivets and other fasteners. For example, if coatings are deposited too thickly to aluminum alloys, the coating's resilience (i.e., the strength or integrity of the coating) is weakened. If too thin a coating is deposited, corrosion protection and overall component performance may suffer. Further, coating application methods where one layer of coating is delivered over many separate applications is unacceptable since the multiple bond layers introduced between coating applications cannot be reliably cured to produce the proper cross-linking necessary to achieve the optimum strength levels required.

Such coating tolerances were previously difficult to obtain using known methods for small, irregularly shaped aluminum-alloy components, such as rivets and other fasteners.

Therefore, there exists a need for an improved approach to the application of corrosion inhibiting coatings to aluminum-alloy aircraft structural components, such as rivets, fasteners, small and irregularly-shaped components, etc., and the mechanical, aircraft structures attached to these aforementioned components.

SUMMARY OF THE INVENTION

The present invention provides an improved method for pre-coating and pre-treating aluminum-alloy, aircraft components such as fasteners, rivets, small and irregularly-shaped components, etc., and the mechanical, aircraft structures attached to these aforementioned components. Heat-treatable components are heat-treated to obtain acceptable mechanical properties and also are protected by a cured organic coating. Cold-worked and/or non-heat-treatable components have a coating applied to the component and cured while still achieving the desired deformation state in the final component. The application of the coating does not adversely affect the desired formal properties of the finished component.

In one preferred embodiment of the present invention an aluminum-alloy fastener is prepared by providing an aluminum-alloy component precursor to an apparatus having a fluidized bed or mist. The apparatus is activated to deliver gas at a predetermined velocity to create an airstream. The airstream impacts the components to suspend and raise them vertically. A coating in a vapor, atomized state is introduced to the apparatus such that the coating impacts the suspended components and is deposited on the component uniformly to a controlled thickness during a predetermined period of time. The component remains exposed within the gas flow airstream to dry the coating after the vaporized coating is discontinued in the apparatus. The gas flow is then turned off, and the uniformly-coated components are then removed from the apparatus.

The preferred coating apparatus according to one embodiment is a fluidized-bed apparatus comprising three vertically-contiguous sections. The upper section constitutes an expansion zone. The intermediate section has an upwardly extending first wall. The lower section includes a second wall, inwardly-tapered frustoconically as it extends downward and terminates in a bottom gas inlet. The intermediate and lower sections constitute a fluidized-bed vessel. The second wall has an interior wall surface being divided into an upper portion and lower portion. The upper portion is defined by the area of vertical movement of a rotor disc, widening frustoconically in an upward direction. The rotor disc is substantially flat and can be moved vertically. The apparatus has a vacuum assembly positioned above and in fluid communication with the upper section to pull a gas flow into the vessel through an annular gap around the periphery of the rotor disc. The apparatus further has a valve for releasing material to be treated into the fluidized bed above the rotor disc. A plurality of nozzles positioned below the expansion zone introduce the coating to the material to be treated.

The components preferably are small, irregularly-shaped aircraft structural components including fasteners, rivets, hinges, fittings, etc. Any small, irregularly-shaped component that can be provided to a fluidized-bed or mist apparatus and raised to a suspended state via directed gas pressure and flow can be treated according to the present invention. It is preferred that the components remain completely suspended in the airstream during the coating process. However, it is understood that the components may randomly contact the chamber walls or floor. Therefore, the present invention also contemplates the coating of completely suspended and substantially suspended aircraft structural components.

Small components are able to be coated in the fluidized-bed or mist apparatus in batches or lots of from about 25,000 to about 30,000 pieces per batch or more for running times of from about 10 to about 15 minutes or longer depending upon the volume and density of the vaporized coating desired to be released into the apparatus and the mass and density of the components.

In a further preferred embodiment, a coating is delivered to the surface of aluminum-alloy aircraft components without the components contacting each other to achieve a final coating thickness tolerance of from about 0.00015 inch to about 0.0003 inch.

Other features and advantages of the present invention will be apparent from the following more detailed description of the preferred embodiments, taken in conjunction with the accompanying drawings, which illustrate, by way of example, the principles of the invention.

DETAILED DESCRIPTION OF THE INVENTION

The process of the present invention deposits uniform coatings on the aluminum alloy and obviates the need for use of wet sealant during installation and assembly. With regard to aircraft rivets and fasteners, the elimination of the requirement for the wet sealant installation approach for the over 700,000 rivets in a large cargo aircraft offers a cost savings of several million dollars per aircraft. The elimination of the use of wet sealants also improves the workmanship in the fastener installation, as there is no possibility of missing some of the fasteners as the wet sealant is applied. Further, the coated rivets and other fasteners are more resistant to corrosion during service than are uncoated wet-installed fasteners.

All of these embodiments yield surprising and unexpected technical and cost advantages when used in conjunction with high-strength aluminum-alloy aircraft components such as rivets, fasteners, hinges, small irregularly-shaped components, etc. The aluminum-alloy components exhibit their full required strength produced by the subsequent heat-treatment utilized following application of the coating. Achievement of a specified strength level is important, because users of the components, such as the aircraft industry, will not permit a sacrifice of mechanical performance to achieve improved corrosion protection. In the past, such users have required both acceptable mechanical performance and also the use of wet sealants to achieve acceptable corrosion protection. By contrast, in the present approach the aircraft components have both acceptable mechanical performance and a pre-coating for enhanced corrosion protection, obviating the need for wet sealant.

Figure 1:
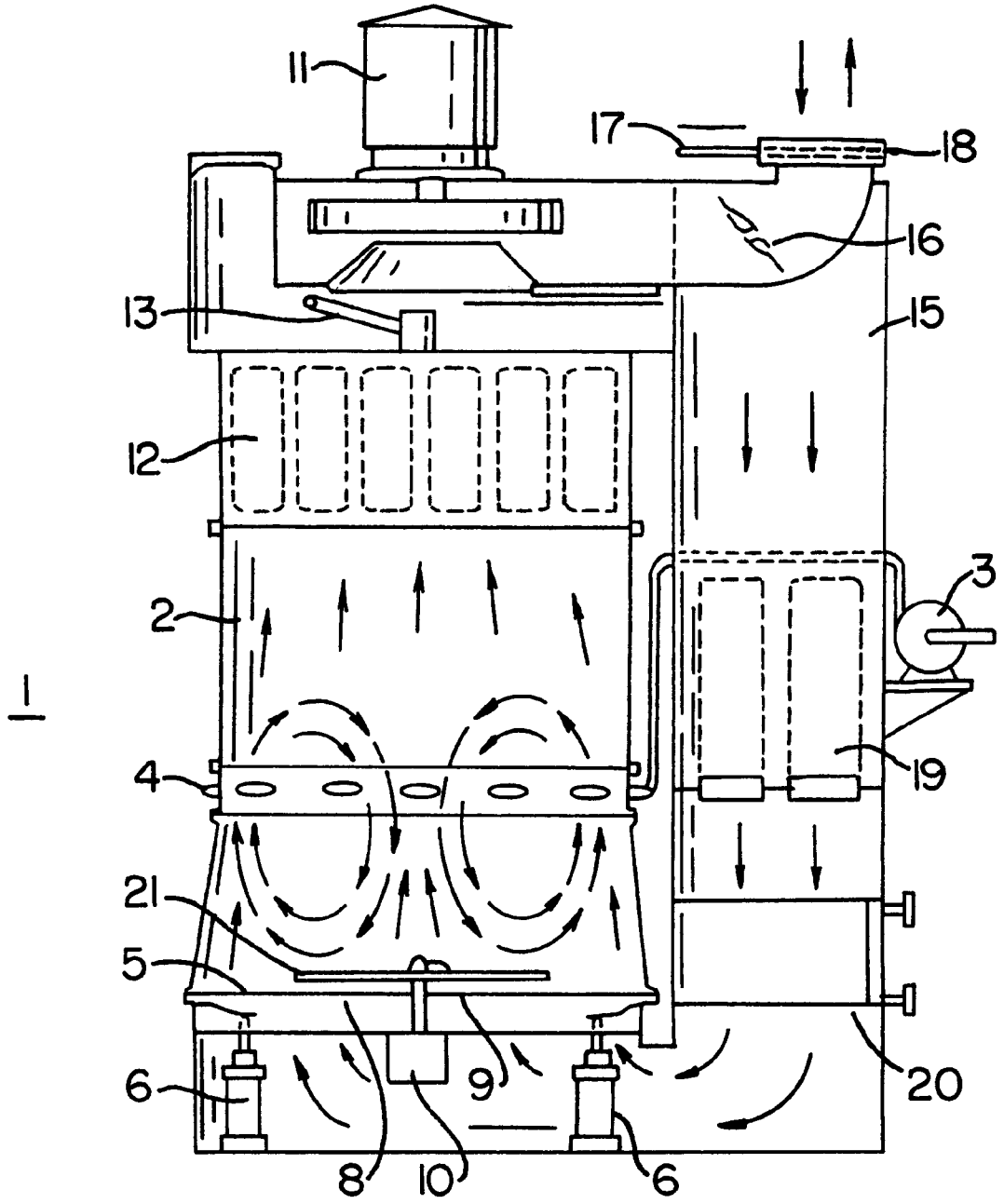
FIG. 1 is a cross-sectional diagram of a fluidized bed apparatus.

FIG. 1 shows a known coating application apparatus using a fluidized bed or mist apparatus. Such an apparatus is the subject of U.S. Reissue Pat. No. Re. 32,307 assigned to Werner Glatt, of Binzer Germany, the entire contents of which are incorporated by reference herein. The process of the present invention is not restricted to any particular type of fluidized-bed apparatus. It is, however, critical that the apparatus have the required capacity to elevate and suspend, for example in an airstream, the components being coated. A typical apparatus is shown in FIG. 1 as having a fluidized-bed or mist vessel 1 which is tapered conically in an upward direction and followed by a cylindrical expansion zone 2. A metering pump 3 supplies granulating liquid or mist to the fluidized-bed vessel 1 through a nozzle ring 4 between the vessel and the expansion zone 2. At its underside, the fluidized-bed vessel 1 is defined by a perforated bottom 5 which may be set into oscillating movement by pneumatic pistons 6. A horizontal perforated rotor disc 8 is spaced above the perforated bottom by, for example, from about 0.5 to about 20 mm and provided in the middle with a conical central core 9. The rotor disc 8 is adapted to be driven by a motor 10. A turbine 11 serves to generate air circulation in the fluidized-bed apparatus. The air which the turbine 11 moves or pulls from the expansion zone 2 passes through a filter 12 which is provided with a tilting mechanism 13 for cleaning purposes. A side channel 15 is disposed laterally adjacent to the fluidized-bed vessel 1, expansion zone 2, and filter 12. Exhaust air and fresh air are adjusted by an exhaust air regulator flap vent 16 and a fresh air regulator slide vent 17, respectively, at air outlet and inlet opening 18. The return air is recycled into the fluidized-bed vessel 1 through prefilter 19 and air heater 20 in the side channel 15 and then through perforated bottom 5.

The aluminum-alloy components to be coated contained in the fluidized-bed or mist vessel are conveyed upwardly by the rising gas or air stream. Subsequently they fall down inwardly toward the rotor disc 8 under gravity. The centrifugal force generated by the rotor disc 8 propels the components again into the air stream flowing from the bottom to the top. In this way, the uniform revolving and circulating movement of the components is obtained.

In one preferred embodiment, the speed of rotation of the rotor disc is adjustable, preferably about 3500–3600 r.p.m. for small aluminum-alloy components, such as fasteners and rivets, having individual masses of from about 0.2 g to about 0.9 g. For larger components, it is understood that the rotor speed will be adjusted in accordance with the desired coating thickness to be applied and the type of coating being applied. Similarly, the pressure of the gas or air flow/stream fed into the vessel to create the airstream is regulatable and is dependent only on the mass of the components (both individually and collectively) to be suspended within the airstream.

The present invention contemplates using a fluidized-bed or mist coating application protocol to coat any aluminum-alloy aircraft component with any desired coating formulation. The preferred coating is an organic, corrosion-inhibiting coating formulation. The coating may require a subsequent aging/curing period conducted at either an elevated or room temperature environment to facilitate curing. Once cured, it is preferred that the coating be tack-free to enable handling. The coating thickness achievable by the present invention may vary according to the preferred end-result characteristics of the coated component. Preferably the coating can be deposited on the components in the range from about 0.00015 to about 0.0003 inches.

Additional coatings may be applied to the first protective coating. In another preferred embodiment, the once-coated rivets are reintroduced to the chamber for the application of additional coatings. These additional coatings may be "adhesive" coatings; coatings preferably containing adhesive particles held in suspension. Again, either an elevated or room temperature aging/curing period is then provided to provide a tack-free surface.

In the present invention, the use of microsuspension bead-technology is contemplated similar to the known technology in the laser jet ink field. In this method, the second coating applied to the once-coated component bursts upon impact to deliver a relatively uniform adhesive interface in a thin final coating of from about 0.0003 to about 0.0005 inches. It is contemplated that this microsphere or bead-like delivery system can be used to deliver various types of useful initiators or catalysts to an aircraft structural component. Such initiators may be Friedel-Crafts ionic catalysts, such as but not limited to metal halides, acids, amines, boron trifluoride, boron trifluoride-ether, etc. The catalysts chosen are preferably matched to the aging/curing requirements.

In one of the embodiments of the present invention, the preferred selected temperature curing regimen of the present invention will be governed by the availability of the active catalyst/initiator and the reactivity of the catalyst/initiator with the monomer or organic compound comprising the first coating. For example, benzoyl peroxide is a suitable polymerization initiator in a free radical polymerization of some vinyl monomers, such as styrene, if heated to approximately 80° C. However, benzoyl peroxide can also be used at lower temperatures in conjunction with higher pressures. In addition, the selected catalyst for the second coating may be an active catalyst; i.e. decomposable at room temperature, such as liquid peroxide. However, it is often necessary to allow such reactive monomers or others such as adhesives (low molecular weight polymers) to be mixed and applied to a substrate in position before it is subjected to a further reaction, such as polymerization, curing, bonding, etc. to another adhesive surface. It is therefore preferred to mix all components to achieve a relatively homogeneous state prior to substrate coating. This applies to monomers with catalysts and also adhesive films applied for subsequent bonding.

The coatings used in the process of the present invention preferably are applied such that no chemical reaction occurs until desired by applying a necessary catalyst or reaction condition such as a temperature or pressure change. In other words, the active materials of the adhesive film which are to be reacted are "protected" from reacting prematurely. Therefore, in one particular embodiment of the present invention, all "active" coatings are provided in an inert medium, but are available for use on demand at room temperature. One preferred method is to encapsulate such "active" materials in a protective, colloidal sphere-like pellet or ball which, upon being subjected to a specified temperature or pressure change, ruptures in a predictable way.

The preferred techniques described herein, particularly useful in connection with the present invention, can be used for depositing onto aluminum-alloy components any catalyst or initiator for any reaction (such as polymerization), cross-linking polymers (such as adhesives), bonding adhesives to substrates, curing elastomers, or any other reaction where a catalyst, especially a room temperature catalyst may be needed on demand. This above-described technique is versatile enough to be used to deposit solid, liquid or gaseous coating materials, including metal salts, or other compounds such as $BF_3$. In addition, encapsulated adhesives may be used latently to facilitate release, such as by applying the encapsulations to the substrate, then later applying pressure or temperature changes.

If depositing encapsulated coatings onto aluminum substrates is desired, it is understood then that the pellets applied to the component substrates can be ruptured in any desired fashion during or after assembly, including simply compressing the two components together during assembly. Once such pellet layers "burst" due to applied compressive forces, a desirable adhesively-bonded interface is achieved between the components. Such a bonding process was discovered to greatly enhance the integrity of the primary coating at the interface of the two mating structural components resulting in enhanced corrosion protection.

By pre-coating aluminum-alloy aircraft structural components with preferred organic coatings, the use of various cumbersome and environmentally undesirable wet sealants is obviated. In addition, according to the present inventions, improved tack-free surfaces are produced by "pre-coating" the components with protective tack-free coatings. Such surfaces enable the aircraft components to be handled in a more flexible, automated assembly process thus greatly reducing production cost and cycle time.

While one preferred embodiment of the invention relates to the preparation of fasteners, such as rivets, the present invention contemplates the use of a fluidized-bed apparatus to coat other small, irregularly-shaped components, limited only by the dimensions of the apparatus and the ability to deliver an airstream capable of lifting and circulating the components. Therefore, use of the invention is not limited to fasteners and rivets, and instead is more broadly applicable. However, its use with fasteners offers particular advantages that will be discussed in detail.

Figure 4:
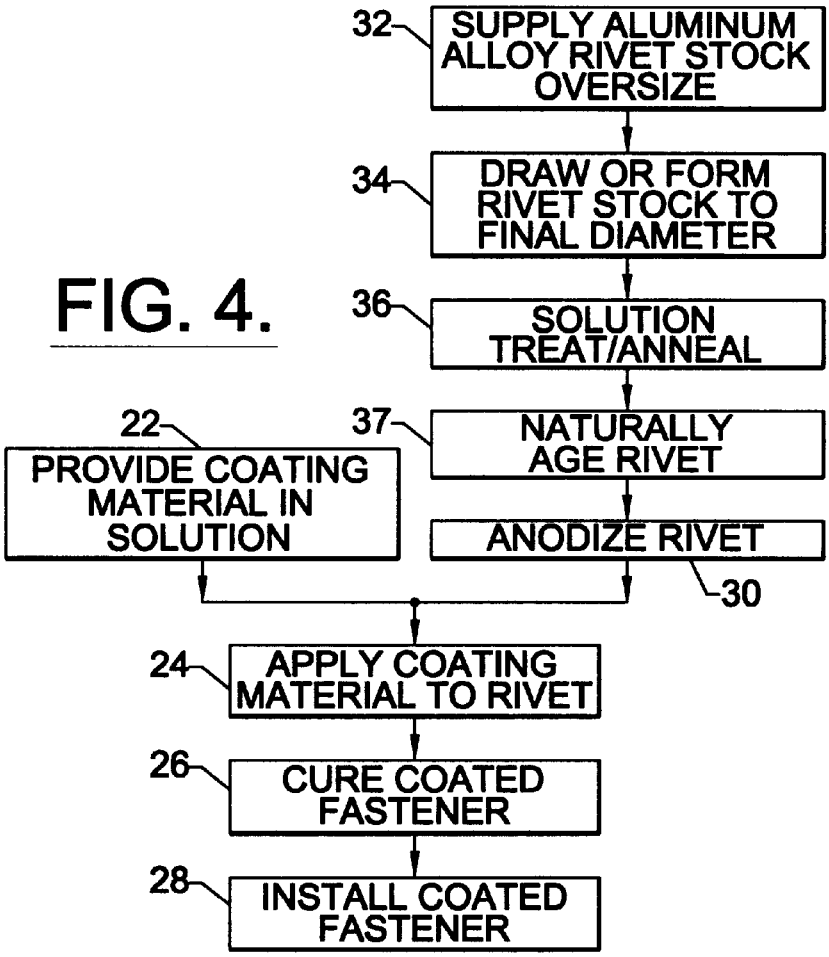
Figure 5:
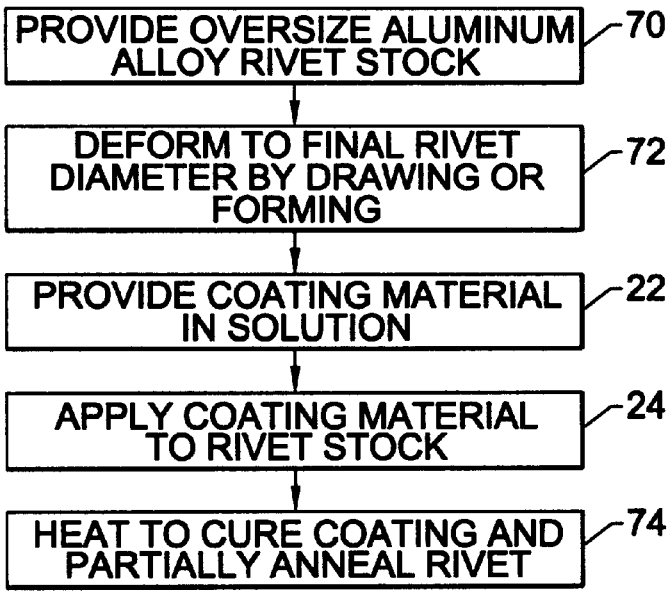
Figure 6:
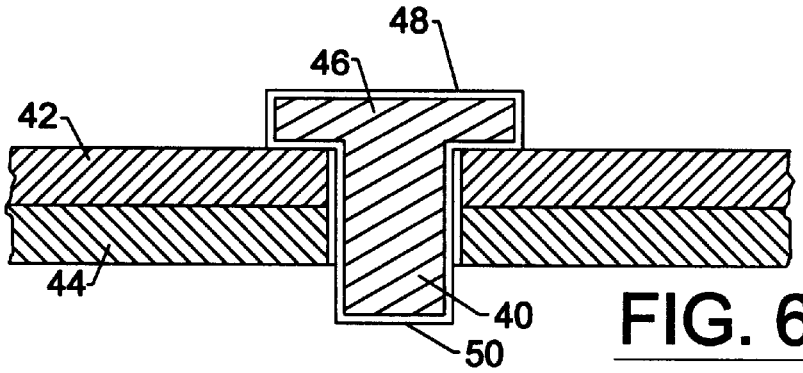
FIGS. 6, 7, 8, and 9 are cross-sectional longitudinal views of pre-coated rivets.
Figure 7:
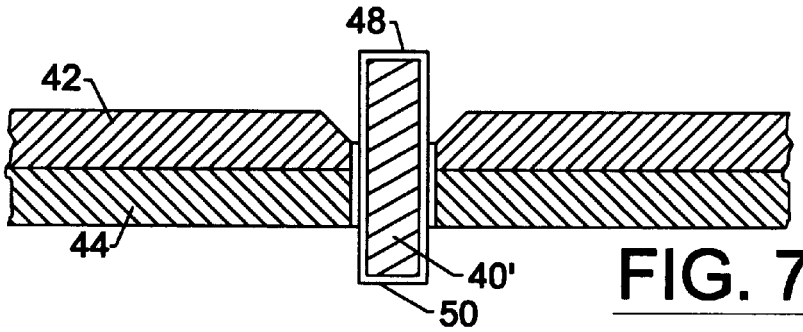
Figure 8:
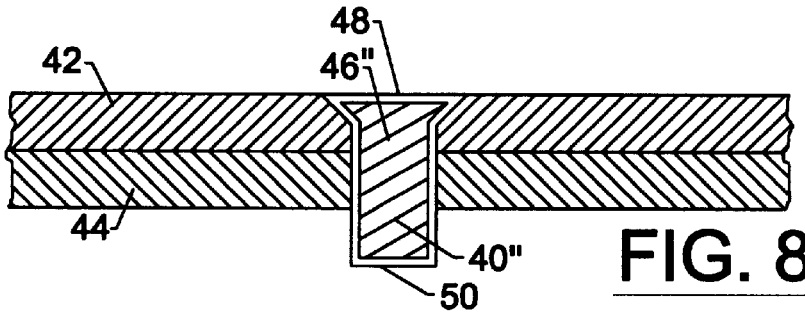

For example, as shown in FIGS. 2–5, a rivet 20 is provided. It is understood that the present invention contemplates the coating of rivets, fasteners, or other small irregularly-shaped articles. FIGS. 6–8 illustrate three types of rivets 40, at an intermediate state of their installation to join a first piece 42 to a second piece 44, after installation to the first and second pieces, but before upsetting. The rivet 40 of FIG. 6 has a pre-manufactured protruding head 46 on one end. The rivet 40' of FIG. 7, a slug rivet, has no preformed head on either end. The rivet 40" of FIG. 8 has a pre-manufactured flush head 46" on one end that resides in a countersink in the piece 42. The present invention may be used with these and other types of rivets, fasteners or components generally.

The preferred rivet is manufactured of an aluminum-base alloy. As used herein, "aluminum-alloy" or "aluminum-base" means that the alloy has more than 50 percent by weight aluminum but less than 100 percent by weight of aluminum. Typically, the aluminum-base alloy has about 85–98 percent by weight of aluminum, with the balance being alloying elements and a minor amount of impurity. Alloying elements are added in precisely controlled amounts to modify the properties of the aluminum-alloy as desired. Alloying elements that are added to aluminum in combination to modify its properties include, for example, magnesium, copper, and zinc, etc.

The aluminum-alloy article preferably is heat-treatable. The article is first fabricated to a desired shape, such as a fastener or rivet. The alloying elements are selected such that the fabricated shape may be processed to have a relatively soft state, preferably by heating it to elevated temperature for a period of time and thereafter quenching it to a lower temperature; a process termed solution treating/annealing. In the solution treating/annealing process, solute elements are dissolved into the alloy matrix (i.e., solution treating) and retained in solution by the rapid quenching, with the matrix itself simultaneously annealed (i.e., annealing).

After the article is solution treated/annealed, it may be further processed to increase its strength several fold to have desired high-strength properties for service. Such further processing, typically by a precipitation-hardening aging process, may be accomplished either by heating to an elevated temperature for a period of time, termed artificial-aging, or by holding at room temperature for a longer period of time, termed natural aging. In conventional Aluminum Association terminology, different artificial-aging precipitation treatments, some in combination with intermediate deformation, produce the T6, T7, T8, or T9 temper conditions, and a natural-aging precipitation treatment produces the T4 condition. (Aluminum Association terminology for heat treatments, alloy types, and the like are accepted throughout the art, and will be used herein). Some alloys require artificial-aging and other alloys may be aged in either fashion. Fasteners such as rivets are commonly made of both types of materials.

In both types of aging, strengthening occurs as a result of the formation of second-phase particles, typically termed precipitates, in the aluminum-alloy matrix. Collectively, all of the processing steps leading to material strengthening is generally termed "heat-treating", wherein the article is subjected to one or more periods of exposure to an elevated temperature for a duration of time, with heating and cooling rates selected to aid in producing the desired final properties. The temperatures, times, and other parameters required to achieve particular properties are known and are available in reference documents for standard aluminum-base alloys.

A specific, artificially-aged aluminum-base alloy of most interest for rivet applications is the 7050 alloy, which has a composition of about 2.3 percent by weight copper, 2.2 percent by weight magnesium, 6.2 percent by weight zinc, 0.12 percent by weight zirconium, balance aluminum plus minor impurities. Other suitable alloys include, but are not limited to, 2000, 4000, 6000, and 7000 series heat-treatable aluminum-alloys. These alloys are available commercially from several aluminum companies, including ALCOA, Reynolds, and Kaiser. After fabrication to the desired shape, such as those shown in FIGS. 6–8, the 7050 alloy may be fully solution treated/annealed to have an ultimate shear strength of about 34,000 to 35,000 pounds per square inch (psi). This state is usually obtained following the fastener's fabrication processing including machining, forging, or otherwise forming into the desired shape. This condition is termed the "untreated state" herein, as it precedes the final-aging, heat-treatment cycle required to optimize the strength and other properties of the material. The article may be subjected to multiple forming operations and periodically re-annealed as needed, prior to the strengthening precipitation heat-treatment process.

After forming (and optionally re-annealing), the 7050 alloy may be heat-treated at a temperature of about 250° F. for 4–6 hours. The temperature is thereafter increased from 250° F. directly to about 355° F. for a period of 8–12 hours, followed by an ambient air cool. This final state of heat-treatment, termed T73 condition, produces a strength of about 41,000 to 46,000 psi in the 7050 alloy, which is suitable for fastener applications.

Figure 2:
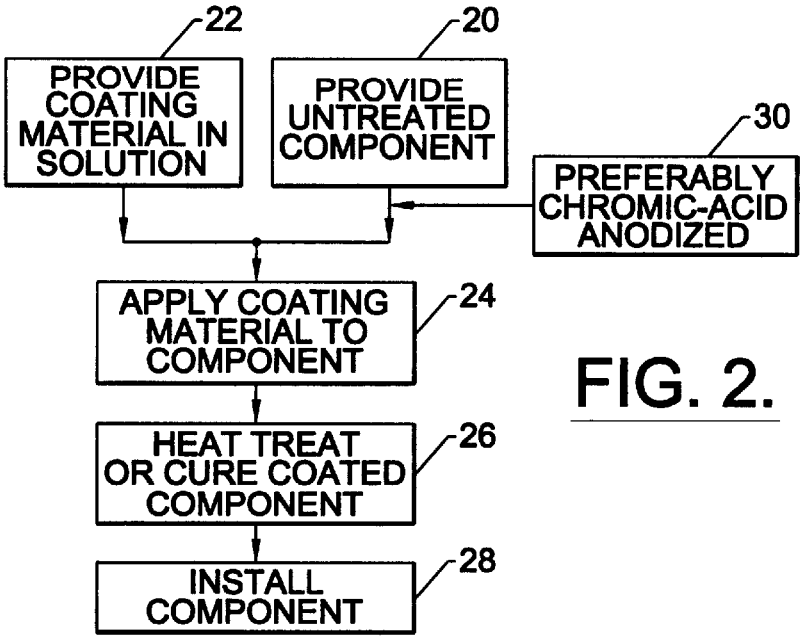
FIG. 2 is a process flow diagram for one embodiment of the method of the invention.

As illustrated in FIG. 2, the untreated fastener is optionally chemically etched, grit blasted or otherwise processed to clean and roughen its surface, and thereafter anodized in chromic-acid solution, number 30. Chromic-acid solution is available commercially or prepared by dissolving chromium trioxide in water. The chromic-acid solution is preferably of a concentration of about 4 percent chromate in water, and at a temperature of from about 90° F. to about 100° F. The article to be anodized is made the anode in the mildly-agitated, chromic-acid solution at an applied DC voltage of from about 18 to about 22 volts. Anodizing is preferably continued for 30–40 minutes, but shorter times were also found operable. The anodizing operation produces a consistent and strongly adherent oxide surface layer of from about 0.0001 to about 0.0003 inches thick on the aluminum-alloy article. The surface layer preferably promotes the adherence of the subsequently applied organic coating. A final step in the anodizing process can also be undertaken to chemically seal the oxide surface layer of the aluminum article. In this case, it was found to be not as desirable to chemically seal the surface in this manner, as the final anodizing step of chemical sealing tends to inhibit the strong bonding of the subsequently applied coating to the aluminum-alloy article.

Other anodizing media were also tested for various anodizing times. Sulfuric acid, phosphoric acid, boric acid, and chemical etch also may be used, but chromic acid is preferred.

As shown in FIG. 2, a coating material is provided, 22, preferably in solution so that it may be readily and evenly applied. The usual function of the coating material is to protect the base metal to which it is applied from corrosion, including, for example, intergranular, galvanic pitting, stress corrosion cracking, fatigue, and crevice corrosion. The preferred coating material is a formulation that is primarily an organic composition, which may contain additives to improve the properties of the final coating. It is desirable to initially dissolve the additives in a carrier liquid so that it can be applied to a substrate. After application, the coating material is curable to effect structural changes within the organic component; typically cross-linking organic molecules to improve the adhesion and cohesion of the coating.

Such a curable coating is distinct from a non-curable coating, (e.g. a lacquer) which has different properties and is not as suitable for the present corrosion protection application. The overaging problems associated with the use of curable coating materials, and which are solved by the present invention, do not arise.

The anodizing process 30, preferably in chromic acid, conducted prior to application of the coating, serves to promote strong bonding of the organic coating to the aluminum-alloy article substrate. The bonding is apparently promoted both by a physical interlocking effect and, as previously discussed, the anodized surface which is not sealed providing an oxide and a chromate-activated chemical bonding effect. To achieve the physical interlocking effect, as previously discussed, the anodized surface is not chemically sealed against water intrusion in the anodizing process. The subsequently applied and cured organic coating seals the anodized surface.

A typical and preferred curable organic coating material has phenolic resin mixed with one or more plasticizers, other organic components such as polytetrafluoroethylene, and inorganic additives such as aluminum powder and/or chromates, such as zinc chromate, barium chromate, magnesium chromate, strontium chromate, etc. These coating components are preferably dissolved and dispersed in a suitable solvent present in an amount to produce a desired application consistency. For the coating material just discussed, the solvent is a mixture of ethanol, toluene, and methyl ethyl ketone (MEK). A typical, preferred sprayable coating solution has about 30 percent by weight ethanol, about 7 percent by weight toluene, and about 45 percent by weight methyl ethyl ketone as the solvent; and about 2 percent by weight strontium chromate, about 2 percent by weight aluminum powder, with the balance being phenolic resin and plasticizer. A small amount of polytetrafluoroethylene may optionally be added. Such a product is available commercially as "Hi-Kote 1" from Hi-Shear Corporation, Torrance, Calif. It has a standard elevated temperature curing treatment of 1 hour at 400° F.±25° F., as recommended by the manufacturer.

The coating material preferably is applied to the untreated fastener article, numeral 24. The coating material is applied using a fluidized-bed or mist apparatus, such as the apparatus illustrated in FIG. 1. As described above, use of a fluidized bed or mist apparatus provides improved coating tolerances and allows the coating of larger batches of components than possible using conventional coating methods, such as spraying, dipping, or brushing. The solvent is removed from the as-applied coating by drying, either at room temperature or slightly elevated temperature, so that the coated article is dry to the touch. Drying is accomplished within the fluidized-bed or mist chamber 1 by stopping the flow of coating material into the chamber while maintaining the coated articles in a suspended state. The gas flow airstream through the chamber drives the coated articles. The coated article is not suitable for service at this point, because the coating is not sufficiently cured and adhered to the aluminum-alloy base metal and because the coating is not sufficiently coherent to resist mechanical damage in service. The preferred aircraft components to be coated may be irregular in shape. The term "irregular" refers to any shape that is complex and unlike the relatively simple geometric shaped objects normally coated in a fluidized bed (i.e. pills and capsules). The present invention contemplates the coating of any sized objects but is especially applicable to coating objects having relatively small surface areas and irregular shapes.

Once removed from the fluidized-bed or mist apparatus, the base metal of the rivet article and the applied coating are together heated to a suitable elevated temperature, 26, to achieve two results simultaneously. In this single step, the aluminum-alloy is precipitation heat-treated by artificial-aging to its final desired strength state, and the coating is cured to its final desired, bonded state. Preferably, the temperature and time treatment of step 26 is selected to be that required to achieve the desired properties of the aluminum-alloy base metal, as provided in the industry-accepted and proven process standards for that particular aluminum-base alloy. This treatment is not that specified by the coating manufacturer and may not produce the most optimal cure state for the coating, but it has been determined that the heat-treatment of the metal is less forgiving of slight variations from the optimal treatment than is the curing treatment of the organic coating. That is, the present invention demonstrates that the curing of the coating can sustain larger variations in time and temperature with acceptable results than can the heat-treatment of the base metal. Contrary to expectations and manufacturer's specifications, the coating cured by the non-recommended procedures exhibits satisfactory adhesion to the aluminum-alloy substrate and other properties during service. Thus, the use of the recommended heat-treatment of the metal yields the optimal physical properties of the metal, and extremely good coating properties.

In the case of the preferred 7050 aluminum-base alloy and Hi-Kote 1 coating discussed above, the preferred heat-treatment is the T73 precipitation treatment aging process of 7050 alloy of 4–6 hours at 250° F., followed by a ramping up from 250° F. to 355° F. and maintaining the temperature at 355° F. for 8–12 hours, and an ambient air cool to room temperature.

Thus, the precipitation treatment of the artificial-aging procedure 26 (FIG. 2) involves significantly longer times at temperature and different temperatures than is recommended by the manufacturer for the organic coating. There was initially a concern surprisingly that the higher temperatures and longer times, beyond those required for the standard curing of the coating, would degrade the coating and its properties during service. This concern surprisingly proved to be unfounded. The final coating 48, shown in FIGS. 6–8, is strongly adherent to the base metal aluminum-alloy and is also strongly internally coherent. In FIGS. 6–8, the thickness of the coating 48 is exaggerated so that it is visible. In reality, the coating 48 is typically from about 0.0003 to about 0.0005 inch thick after treating in step 26 (FIG. 2).

Figure 9:
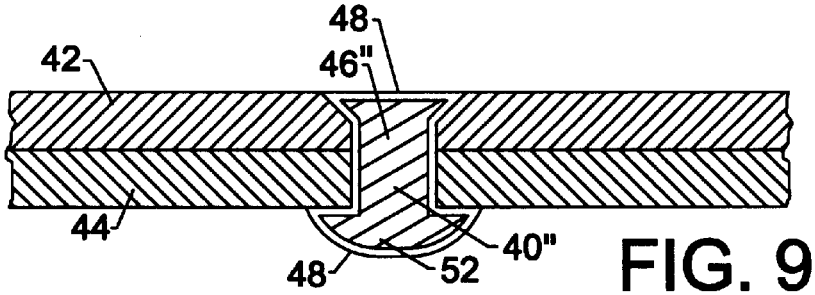

The coated and treated rivet 40 is then installed, 28. The fastener is installed in the manner appropriate to its type. In the case of the rivet 40, the rivet is placed through aligned bores in the two mating pieces 42 and 44 placed into faying contact, as shown in FIG. 6. The protruding remote end 50 of the rivet 40 is upset (plastically deformed) so that the pieces 42 and 44 are mechanically captured between the pre-manufactured head 46 and a formed head 52 of the rivet. FIG. 9 illustrates the upset rivet 40" for the case of the flush head rivet of FIG. 8. The general form of the rivet upset associated with the other types of rivets is similar. The coating 48 is retained on the rivet even after upsetting, as shown in FIG. 9.

The installation step reflects one of the advantages of the present invention. If the coating were not applied to the fastener, it would be necessary to place a viscous, wet-sealant material into the bores and onto the faying surfaces as the rivet was upset, to coat the contacting, mating surfaces. The wet-sealant material is potentially toxic to workers, messy and difficult to work with, and necessitates extensive cleanup of tools and the exposed surfaces of the pieces 42 and 44 with caustic chemical solutions after rivet installation.

Moreover, it has been observed that the presence of residual wet-sealant inhibits the adhesion of later-applied paint topcoats over the rivet heads. Prior to the present invention, the wet-sealant approach was the only viable technique for achieving sufficient corrosion protection, even though there had been efforts to replace it for many years. The present coating approach overcomes these wet-sealant problems. Additionally, the later-applied paint topcoats adhere well over the coated rivet heads, an important advantage.

Rivets made of 7050 alloy are particularly preferred. The rivets, initially in the untreated state, were coated with Hi-Kote 1 and another, but non-chromated coating material, Alumazite ZY-138. Alumazite ZY-138 is a similar coating formulation available from Tiodize Co., Huntington Beach, Calif. Its composition includes 2-butanone solvent, organic resin, and aluminum powder. The coated rivets were precipitation heat-treated to T73 condition with the artificial-aging treatment of 4 to 6 hours at 250° F., followed by a ramping up from 250° F. to 355° F. and maintaining the temperature at 355° F. for 8 to 12 hours, followed by an ambient air cool to room temperature.

The coated rivets were mechanically tested in accordance with MIL-R-5674 to verify that they meet the required ultimate double shear strength requirements of 41,000 to 46,000 pounds per square inch achieved by uncoated rivets. In the testing, the ultimate double shear strength was 42,500 to 43,500 pounds per square inch, within the permitted range. Cylindrical lengths of each type of coated rivet were upset to a diameter 1.6 times their initial diameter to evaluate driveability. No cracking or spalling of the coatings was noticed even on the periphery of the upset region, which is the area that experiences the greatest deformation. Rivets were also installed and subsequently removed to evaluate coating integrity using a scanning electron microscope. The coatings exhibited no signs of cracking, spalling, or any other unacceptable conditions or abnormalities. The coatings were retained on the rivets even after the severe deformation resulting from the upsetting process. Thus, the coatings remained in place to protect the rivet against corrosion after installation, obviating any need for the use of wet sealants.

Figure 3:
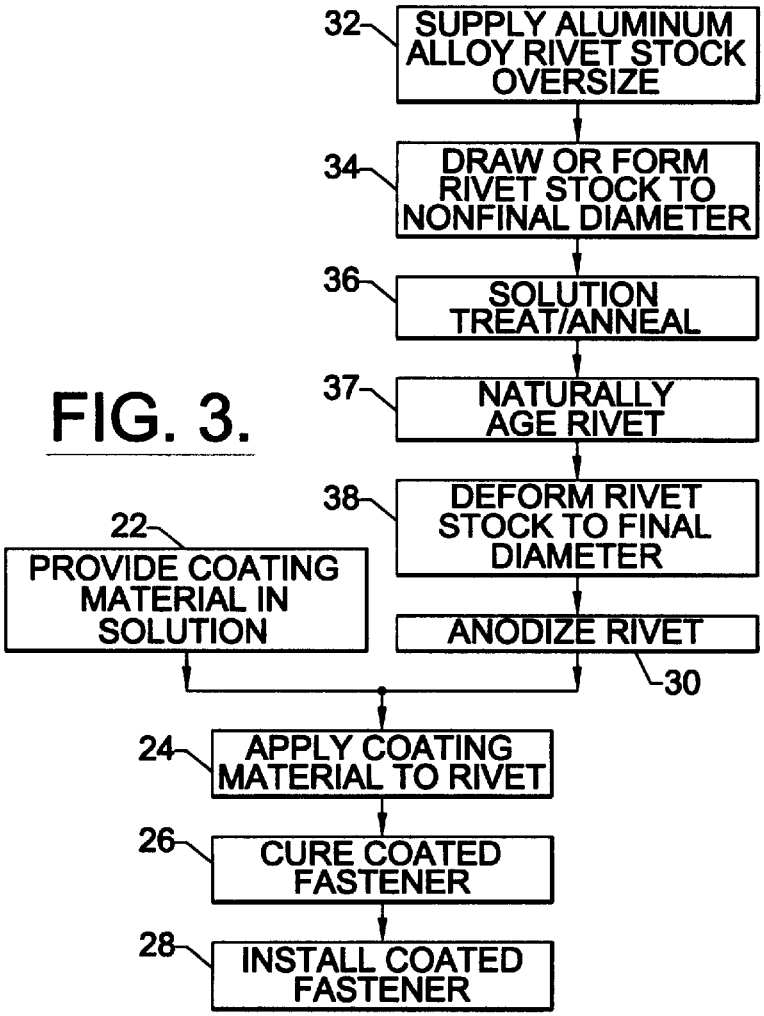
FIGS. 3, 4 and 5 are process flow diagrams illustrating further embodiments of the preferred methods of the present invention.

When aluminum alloys are treated to natural-aged tempers by the approach illustrated in relation to FIG. 2, the aluminum alloy will be overaged due to the heating step 26 required to cure the organic coating. For some fastener applications, overaging of the aluminum alloy is acceptable. In other applications, overaging results in unacceptable properties and must be avoided. FIGS. 3–5 depict procedures for obtaining the benefits of a curable, organic coating applied to alloys treated to natural-aged tempers.

In one approach, depicted in FIG. 3, the aluminum-alloy rivet stock 32 selected for heat treating to a naturally-aged temper is furnished. The rivet stock is supplied slightly oversize (i.e., larger diameter), as compared with the size furnished for conventional processing in which no curable coating is used. The preferred aluminum alloy for heat treatment by natural-aging to the T4 condition is 2117 alloy having a nominal composition of 0.4 to 0.8 percent by weight magnesium, 3.5 to 4.5 percent by weight copper, 0.4 to 1.0 percent by weight manganese, 0.10 percent by weight chromium, 0.2 to 0.8 percent by weight silicon, 0.7 percent by weight iron, 0.25 percent by weight zinc, 0.15 percent by weight titanium, 0.05 percent by weight maximum of other elements, with a total of other elements of no more than 0.15 percent by weight, with the balance being aluminum. The 2117 alloy is available commercially from several aluminum companies, including Alcoa, Reynolds, and Kaiser. This alloy may be hardened by natural-aging to the T4 condition at room temperature for at least about 96 hours, developing a shear strength of about 26,000 to 30,000 psi. (This natural-aging heat-treatment step is subsequently performed in step 37 of FIGS. 3 and 4.) The approach is also operable with other alloys that may be aged with a heat-treatment of natural-aging, such as, for example, 2017, 2024, and 6061 alloys.

The fastener is deformed to a size different from, and typically larger than, the desired final size, 34, a state termed by the inventor "oversize normal". In the case of cylindrically symmetrical rivet, the rivet stock is preferably drawn to an oversize normal diameter that is typically about 10 to 15 percent larger than the desired final size. The oversize normal drawn rivet stock is solution- treated/annealed according to the procedure recommended for the aluminum alloy, 36. In the case of the preferred 2117 alloy, the solution-treatment/aging is accomplished at about 890° to about 950° F. for 1 hour, followed by quenching. The rivet stock is naturally-aged according to recommendations for the alloy being processed, room temperature for a minimum of about 96 hours in the case of 2117 alloy, 37. The drawn and solution-treated/annealed and aged stock is thereafter deformed by cold-working, typically drawing, to its final desired diameter, 38, a step termed redrawing or cold-working. (However, equivalently for the present purposes, the step 34 may be used to deform the rivet stock to a smaller size than the desired final size, and the step 38 may be used to deform the rivet stock to the larger final size, as by a cold-heading operation.) This cold-working imparts a light deformation to the rivet. The cold-worked rivet stock is optionally anodized, preferably in chromic-acid solution, and preferably left unsealed, 30, using the approach described earlier. The coating material is provided in solution, 22, and applied to the rivet stock, 24. Steps 30, 22, and 24 as described hereinabove in relation to FIG. 2 are incorporated here.

The coated fastener stock is cured, 26. The preferred curing is that recommended by the manufacturer, most preferably 1 hour at 400° F. as described previously. However, a modified curing operation may be employed, depending upon the level of cold-working performed on the fastener in step 38. The modified curing cycle is 45 minutes at 375° F. and has been demonstrated to produce acceptable results consistent with the requirements for coating material. The curing operation has the effect of tending to overage the aluminum alloy, which normally requires only natural (room temperature) aging to realize its full strength. However, most surprisingly, it has been found that the additional cold-working operation of step 38, conducted after the solution treat/anneal of step 36 and the natural-aging of step 37, offsets the overaging effect of step 26 and results in the final rivet that is coated and aged to acceptable aluminum-alloy properties, but not overaged.

As shown in FIG. 4, the aluminum-alloy rivet stock is supplied in an oversize condition 32. In this alternate mode for heat-treating and coating articles being treated to a natural-aged temper, the rivet stock is drawn or formed to its final size 34. (This is distinct from step 34 of FIG. 3 wherein the rivet stock is deformed to the oversize normal diameter.) The drawn rivet stock is solution-treated/annealed 36, and naturally-aged 37. No step 38 of drawing to the final diameter is required, as in the procedure of FIG. 3. The remaining steps 22, 30, 24, 26, and 28 are as described previously in relation to FIG. 3, and incorporated here.

The approach of FIG. 4 also has been successfully practiced using 2117 aluminum-alloy. Rivet stock was provided in an oversize diameter of about 0.200 to 0.205 inch, step 32, as compared with a conventional starting diameter of 0.185 to 0.186 inch. The oversize rivet stock was drawn to a diameter of 0.185 to 0.186 inch in step 34 and cold-headed to a diameter of 0.187 to 0.188 inch in step 34. The other steps of FIG. 4 were as described previously for the 2117 aluminum-alloy. The required strength of T4 temper was achieved, and additionally the rivets were protected by the adherent coating.

In the procedures of FIGS. 3 and 4, the extra mechanical cold-working of the rivet stock in the deformation process contained in steps 34 and 38 from the initial oversize diameter of step 32, coupled with the extraordinary heating involved in the curing step 26, results in a final strength and other mechanical properties that meet the required standards and specifications for fasteners of this type. The extra mechanical cold-working tends to raise the mechanical properties above the acceptable limits, while the extraordinary heating during curing reduces the mechanical properties back to the acceptable range. Exact balancing of these effects even permits the mechanical properties to be set at the high side or the low side of the range permitted by most standards. The processing modifications yield the important further benefit that the fastener is coated with a cured coating that protects the fastener from corrosion.

Some alloys are not solution-treated/annealed and precipitation heat-treated prior to use, but instead are used in a cold-worked state with a minimum level of deformation-induced strength. These alloys are termed work-hardenable or wrought alloy. The required deformed state of such alloys would apparently be incompatible with heating to elevated temperature to cure the coating. However, it has been demonstrated that a processing, such as that illustrated in FIG. 5 for a further preferred embodiment of the invention, permits the alloy to be used in a strengthened state induced by deformation and also to be coated with a curable coating. A preferred such alloy is 5056-H32, having a nominal composition of 4.5 to 5.6 percent by weight magnesium, 0.10 percent by weight copper, 0.05 to 0.20 percent by weight manganese, 0.30 percent by weight silicon, 0.40 percent by weight iron, 0.05 to 0.20 percent by weight chromium, 0.10 percent by weight zinc, 0.05 percent by weight maximum of any other element with 0.15 percent by weight total of other elements, and a balance of aluminum. The 5056 alloy, when deformed by cold-working with about 2 to 3 percent reduction to reach the H32 state, exhibits 26,000 to 28,000 psi ultimate shear strength. If, however, the 5056 alloy is thereafter heated for 1 hour at 400° F., the standard curing treatment for the curable coating material, the ultimate shear strength is reduced to about 24,000 to 26,000 psi, which is at the very low side of the range permitted by the strength specification but which is deemed too low for commercial-scale operations because of processing variations that may result in strength below the strength specification for some treated articles.

FIG. 5 illustrates a procedure by which the required mechanical properties are achieved while also having the advantages of a cured coating, for the preferred case of the rivet. The 5056 aluminum-alloy material is provided in an initial, oversize condition 70. For example, conventionally a rivet having a final diameter of 0.187 to 0.188 inch is drawn from stock initially having a final diameter of 0.187 to 0.188 inch is drawn from stock initially having a diameter of about 0.190 to 0.191 inch. In the preferred embodiment of the method of FIG. 5, the precursor stock material is initially about 4 to about 5 percent oversize (e.g., a diameter of 0.195 inch for the case of a rivet of final diameter about 0.187 to 0.188 inch). The oversize stock is deformed, preferably by cold-working, to the required final diameter 72. The rivet precursor, because it has been cold-worked and therefore deformed from a size larger than that required to achieve H32 condition, has a strength greater than that required in the H32 condition. The coating material is provided, 22, and applied to the as-deformed rivet precursor material 24. Optionally, the rivet precursor material may be treated to roughen and clean its surface and preferably anodized in chromic acid (but preferably not chemically sealed) prior to application of the coating material, as previously described.

The coated rivet precursor material is heated to accomplish the standard curing cycle of 1 hour at 400° F. or the modified curing cycle of 45 minutes at 375° F., 74. The curing cycle has two effects. First, the coating is cured so that it is coherent and adherent to the aluminum-alloy rivet. Second, the aluminum-alloy material is partially annealed to soften it. The partial softening or annealing treatment reduces the state of cold-worked deformation in the rivet from that achieved in the overworking operation 72 to that normally achieved by the H32 treatment. The rivet may therefore be installed by the procedures already known for the 5056-H32 rivet. However, the rivet differs from conventional 5056-H32 rivets in that it has the coating cured thereon.

The approach of FIG. 5 has been practiced using the materials and sizes discussed previously. The initially oversize aluminum-alloy stock provided in step 70 has an ultimate shear strength of 25,000–26,000 psi. After drawing in step 72, the stock has an ultimate shear strength of 27,000–28,000 psi. After heating in step 74, the final rivet has an ultimate shear strength of 26,000–27,000 psi, which is comfortably within the range required by the H32 mechanical property specification. By comparison, if the aluminum-alloy stock is initially not oversize, but has the conventional starting diameter, the final rivet subjected to the remaining steps 72, 22, 24, and 74 has an ultimate shear strength of 24,000–26,000 psi, at the very low end of that required by the H32 specification and which, as discussed earlier, is too low for commercial operations.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for preparing an aluminum-alloy aircraft component, comprising the steps of:

providing an irregularly shaped aluminum-alloy component precursor having an individual mass of from about 0.2 to about 0.9 g;

providing a coating apparatus comprising by three vertically contiguous sections, an upper section constituting an expansion zone, an intermediate section having a first wall extending upwardly, and a lower section including a second wall tapered inwardly frustoconically as it extends downwardly and terminating in a bottom inlet for gas, said intermediate and lower sections constituting a fluidized-bed vessel, with said second wall having an interior wall surface being divided into an upper portion and a lower portion, said upper portion being defined in the area of vertical movement of a rotor disc, said upper portion widening frustoconically in an upward direction, and a substantially horizontal rotor disc having a substantially flat bottom and being arranged for vertical movement, said rotor disc arranged above said bottom inlet of said vessel and below the top of said lower section and in radial proximity with said upper portion of said interior wall surface of said lower section, an adjuster for adjusting the vertical height of the rotor disc, a rotor for rotating the rotor disc, a vacuum assembly positioned above and in fluid communication with the upper section for pulling a flow of gas into the vessel through the bottom inlet and through an annular gap around the periphery of the rotor disc so that the flow of gas follows the outwardly widening wall surface of the lower section, a valve for releasing material to be treated into the fluidized bed above the rotor disc to form a fluidized bed moved by the rotor disc and the flow of gas being pulled through the annular gap, a plurality of nozzles positioned below the expansion zone for introducing a coating into the fluidized-bed vessel, whereby the gas is released at an initial gas flow velocity and the velocity of the gas flow is adjusted to the mass, or density, particle size and surface area characteristics of the precursor by varying the height of the rotor disc in relation to the upper portion of the interior walls of the vessel to decrease the gas and increase the gas flow velocity and alternatively to increase the gap and decrease the gas flow velocity;

introducing the component to the apparatus;

directing a gas flow to the apparatus interior;

introducing a corrosion resistant coating material to the apparatus interior;

engaging the apparatus to an operable function; and coating the precursor to achieve a substantially uniform coating thickness from about 0.00015 to about 0.0005 inch.

2. The method of claim 1, wherein the step of providing an aluminum-alloy component includes the step of providing an aircraft structural component.

3. The method of claim 2, wherein the aircraft structural component is irregularly shaped.

4. The method of claim 2, wherein the step of providing an aircraft structural component includes the step of providing a component selected from the group consisting of hinges, rivets, fasteners, and fittings.

5. The method of claim 1, wherein the aluminum alloy component is made from 2000, 4000, 6000 and 7000 series heat-treatable alloys.

6. The method of claim 1, wherein the aluminum alloy component is made from a work-hardenable alloy.

7. The method of claim 1, wherein the aluminum alloy component is made from a 5000 series work-hardenable alloy.

8. The method of claim 1, wherein the aluminum alloy comprises from about 4.5 to about 5.6 weight % magnesium, about 0.10 weight % copper, 0.05 to about 0.2 weight % manganese, about 0.30 weight % silicon, about 0.40 weight % iron, from about 0.05 to about 0.2 weight % chromium and about 0.10 weight % zinc.

9. The method of claim 1, wherein the step of coating the precursor includes coating to a thickness of from about 0.00015 to about 0.00030 inches.

10. The method of claim 1, wherein the step of providing an aluminum-alloy component precursor includes the step of providing an aluminum-alloy component in its fully solution-treated and annealed state.

11. The method of claim 10, wherein the aluminum-alloy component has a shear strength of from about 41,000 to about 46,000 psi.

12. The method of claim 1, wherein the step of providing a coating includes the step of providing a curable, organic coating material comprising a phenolic resin.

13. The method of claim 12, wherein the phenolic resin is selected from the group consisting of phenols, aldehydes and novolaks.

14. The method of claim 12, wherein the step of providing a coating includes the step of providing a phenolic resin selected from the group consisting of phenol/formaldehyde and alkyl phenol/formaldehyde.

15. The method according to claim 12, wherein the phenolic resin coating comprises about 30 weight % ethanol, about 7 weight % toluene, about 45 weight % methyl ethyl ketone, about 7 weight % strontium chromate and about 2 weight % aluminum powder.

16. The method of claim 1, further comprising the step of:

providing a second coating material; and coating the component with the second coating material while the component is at least partially suspended in the chamber.

17. The method of claim 16, wherein the second coating comprises an adhesive.

18. The method according to claim 16, wherein the second coating comprises encapsulants.

19. The method of claim 16, wherein the step of providing a second coating includes providing an adhesive selected from the group consisting of acrylic adhesives, urethane adhesives, phenolic adhesives, and melamine adhesives.

20. The method of claim 16, wherein the step of providing a second coating material includes the step of providing a catalyst.

21. The method of claim 16, wherein the step of providing a second coating includes the step of providing a catalyst selected from the group consisting of cationic catalysts, anionic catalysts, and radical catalysts.

22. The method of claim 20, wherein said catalyst is a Friedel-Crafts catalyst selected from the group consisting of metal halides, acids, amines, boron trifluoride, boron trifluoride-ether, and mixtures thereof.

23. The method of claim 1, wherein the step of providing an aluminum-alloy includes providing a component having a faying surface.

24. The method of claim 1 wherein the component is irregularly shaped.

25. The method of claim 1 wherein the component is selected from the group consisting of hinges, rivets, fasteners, and fittings.

* * * * *